United States Patent [19]

Babington

[11] 4,298,338

[45] Nov. 3, 1981

[54] LIQUID FUEL BURNERS

[75] Inventor: Robert S. Babington, McLean, Va.

[73] Assignee: Owens-Illinois, Inc., Toledo, Ohio

[21] Appl. No.: 37,190

[22] Filed: May 8, 1979

[51] Int. Cl.[3] ..... F23D 15/04

[52] U.S. Cl. ..... 431/352; 431/118; 431/175; 431/265; 431/285; 431/351; 239/433; 239/543

[58] Field of Search ..... 431/285, 351, 352, 117, 431/118, 175, 265; 60/39.65; 239/543, 433, 434, 418, 338; 261/78 A

[56] References Cited

U.S. PATENT DOCUMENTS

| | | | |
|---|---|---|---|
| 1,345,361 | 7/1920 | Good | 60/39.65 |
| 1,519,152 | 12/1924 | Messer | 431/285 |
| 1,803,967 | 5/1931 | Good | 431/117 |
| 2,250,680 | 7/1941 | Schlitt | 431/351 |
| 2,742,762 | 4/1956 | Kuhring | 60/39.65 |
| 3,238,994 | 3/1966 | Kirk | 431/117 |
| 3,425,058 | 1/1969 | Babington | 431/117 |
| 3,589,845 | 6/1971 | Morse | 431/285 |
| 3,637,336 | 1/1972 | Velie et al. | 431/265 |
| 3,751,210 | 8/1973 | Babington et al. | 431/237 |
| 4,155,700 | 5/1979 | Babington | 431/117 |

OTHER PUBLICATIONS

"Clog-Proof Superspray Oil Burner", Norman Metzger, *Popular Science,* Jan. 1976, pp. 64-66.

*Primary Examiner*—Samuel Scott
*Assistant Examiner*—Lee E. Barrett
*Attorney, Agent, or Firm*—Pollock, Vande Sande & Priddy

[57] ABSTRACT

An improved fuel burner particularly adapted for domestic use and capable of burning fuels such as fuel oil and the like with extremely high efficiency and low pollutant output is comprised of a pair of plenum type atomizers (26,26'), each having a convex surface onto which the fuel is flowed for atomization, the atomizers (26,26') being disposed at the end of a flame tube (3) which in turn is located within a blast tube (1), said atomizers (26,26') further being disposed symmetrically with respect to the axis of both the flame tube (3) and the blast tube (1) whereby the spray output from the atomizers is discharged into the flame tube (3) to create a stable flame front that can be readily ignited by a spark type of ignitor (18). The atomizers are provided with one or more apertures (29') through which atomizing gas is passed to generate the spray, and air access ports (12,12',13) are located along the flame tube to provide the necessary air to complete the combustion process.

13 Claims, 7 Drawing Figures

LIQUID FUEL BURNERS

DESCRIPTION

TECHNICAL FIELD

As is well recognized in the industry, there has been a need to develop and to provide a fuel burning system which is capable of burning a liquid fuel in a very efficient manner with little or no smoke, and with minimal pollution to the atmosphere.

In the case of existing residential oil burners, the burner must operate with low smoke emissions to prevent sooting of the heat exchanger and the objectionable pollution of residential neighborhoods. The result is that large amounts of excess air must be introduced in the present residential combustion process to assure that the burner operates at acceptable smoke levels.

It is well known that the performance of the high pressure oil burner that is used almost exclusively in residential heating applications today will vary dramatically from one furnace or boiler design to the next. This is because the high pressure nozzle does a poor job of atomizing the fuel. These nozzles produce a substantial number of large droplets which impinge upon the walls of the combustion chamber and burn slowly. The speed at which these particles finally vaporize and burn depends upon the size, shape, and residual heat within the furnace or boiler's combustion chamber. It can be said then that the combustion chamber within the furnace or boiler serves as a receptacle to capture large droplets of fuel and as an after-burning device to burn these large droplets of fuel. Indeed, if the existing high pressure oil burner were capable of atomizing fuel oil to a high degree, the heat exchanger could be coupled directly to the burner and there would be no need for a hot combustion chamber or firebox to complete the combustion process.

In many instances, the conventional oil burner may be 2–3 times larger than is necessary to provide adequate space heating. This is the case when the same burner is required to provide heat for hot water in addition to heat for home comfort. When outside temperatures are low, and hot water demands are high, a high pressure burner in this type of system must be able to satisfy both requirements. This maximum heat load is what normally determines the firing rate of the burner. However, when the demand for heat is low, as in the spring and fall months, and hot water demands are at a minimum, as would be the case at night, the burner will still operate at the same firing rate as it does when heating and hot water demands are high. The only difference is that when the heating requirements are low, the burner will stay on for a very short period of time. As is well known, this mode of operation is very inefficient. During the short "on" cycle, the burner cannot achieve smokeless operation and reasonable efficiency before the thermostat cuts it off. During the "off" cycle, the residual heat in the furnace is dissipated to the atmosphere and this contributes to increased heat loss. During the off cycle, there is also a loss of heat within the house as the warm air escapes through the furnace stack. From this description it can be appreciated that the most economical domestic oil burner system would be one in which the burner operates continuously with the ability to vary its output to satisfy the fluctuating heat requirements within the household. In this way, there can be no inefficiencies associated with repeated startup and shutdown. A quick calculation will show that the added electrical cost for continuous burner operation is very minimal compared with the fuel savings that can be realized.

BACKGROUND ART

An innovative approach to fuel burners is illustrated in U.S. Pat. No. 3,425,058, issued Jan. 28, 1969, to Robert S. Babington. The burner therein disclosed represents an adaptation of the liquid atomization principles disclosed in U.S. Pat. Nos. 3,421,699 and 3,421,692, issued Jan. 14, 1969, to the same named inventor and his co-inventors in developing the apparatus and method shown in these patents.

In brief, the principle involved in the aforementioned patents is that of preparing a liquid for spraying by causing it to spread out in a thin film over the exterior surface of a hollow plenum chamber which contains at least one orifice. When gas is introduced into the interior of the plenum, it escapes through the aperture and thereby creates a very uniform spray of small liquid particles.

By varying the number of apertures, the configuration of the apertures, the shape and characteristics of the surface, the velocity and amount of liquid supplied to the surface, and by controlling the gas pressure within the plenum, the quantity and quality of the resultant spray can be optimized to suit the particular burner application.

It is this basic principle, described above, that was utilized in the development of the burner disclosed in said U.S. Pat. No. 3,425,058.

In the above mentioned patent, the burner is so simple that it might even be called a fuel atomizing subsystem for a burner rather than a complete burner. Indeed, from this very simple burner or subassembly evolved the more sophisticated and complete burner described in the present invention. In the earlier said U.S. Pat. No. 3,425,058, the burner is comprised of a simple atomizing chamber having a cover thereover, the cover being provided with a spray discharge port to discharge the atomized fuel in a generally vertical direction. Disposed within the atomizing chamber is a hollow plenum type atomizer that is in communication with an outside source of pressurized air. Liquid is introduced into the atomizing chamber so as to flow over the exterior surface of the atomizing plenum. Exesss fuel that is not sprayed off flows downwardly into a drain where it is recirculated via a pump means to the liquid supply line. The atomizing plenum is provided with a small aperture centrally located beneath the opening in the cover, and the air exiting therefrom creates a fine mist which is discharged upwardly and out of the atomizing chamber for combustion external to the system. Means comprising a series of regulatable apertures are also provided in the atomizing chamber such that aspirated air can be drawn into said chamber or burner and mingled with the spray as it discharges from the opening in the top cover.

From this very simple version of a fuel burner was derived more sophisticated equipment, such as that shown and discussed in an article in the Jan. 1976 issue of Popular Science entitled "Clog-Proof Super Spray Oil Burner". As noted in the article, one development that evolved was the use of two atomizing plenums arranged to discharge the atomized liquids towards each other to create a more stable flame and a good place to initiate ignition.

Other arrangements of opposed spray heads are also suggested in U.S. patents by Babington. namely U.S. Pat. No. 3,751,210 dated Aug. 1973, and U.S. Pat. No. 3,864,326 dated Feb. 1975.

All of the above noted developmental work based on the utilization of the "Babington" principle proved conclusively that the system was perfectly capable of use in a fuel burning system and that, if properly designed, such a system has the potential of evolving into a commerical, practical, highly efficient fuel burner which can be used for domestic heating furnaces.

DESCRIPTION OF THE INVENTION

The present invention deals with a novel fuel burner, particularly adapted for use in practically every type of domestic heating furnace and, in particular, as a retrofit burner for existing heating systems. Fuel oil can be burned close to the maximum theoretical efficiency and with smoke readings which are zero at the instant the burner is ignited and which remain at zero throughout the burner operation.

In the present invention, the inefficiencies associated with many on-off burner cycles are eliminated. By simply controlling the liquid film thicknesses over the atomizing surfaces as will be described, the firing rate of the burner can be modulated over a typical range of 5–1. This means that the same burner, without changing atomizers, can be modulated either manually or automaticaly to match the heating and/or hot water loads in the house. For example, during modestly cool spring and summer evenings, the burner can be set to operate at a firing rate of 0.2 gal./hr. and during cold winter days when hot water is required, the same burner can be adjusted to consume fuel at a rate of 1.0 gal./hr. These adjustments can be made manually by simply adjusting the fuel flow rate over the atomizing plenums by means of a simple valve in the liquid combustion air delivered to the flame tube. In the most sophisticated version of the novel burner disclosed herein, these adjustments can be made automatically with suitable control techniques. Accordingly, an object of the present invention is to produce an oil burner whose firing rate can be simply modulated either manually or automatically to suit the heating demand.

Another object of the invention is to produce a burner that performs with high efficiency regardless of the combustion chamber that it is placed into and therefore is ideally suited as a retrofit or replacement burner for existing furnaces.

Another object of this invention is to produce an oil burner that will permit substantial reductions in energy costs when retrofitted into existing furnaces.

Still another object of this invention is to produce an oil burner with an exceptionally stable flame front.

Still another object of the invention is to produce a burner that is capable of operating at low firing rates, as for example less than 0.5 gal./hr. without clogging problems.

A further object of this invention is to produce an oil burner wherein combusion is essentially completed within the flame tube of the burner.

Still another object of this invention is to produce an oil burner where combustion air is supplied in stages so as to control the burning rate and temperature and hence objectionably high nitrous oxide emissions.

The burner of this invention comprises a flame tube having an inlet end and outlet end; means for admitting air into the flame tube to cause said admitted air to flow in a direction along and parallel to the central axis of said tube; and a plurality of second means for producing a corresponding plurality of streams of atomized fuel which are angled toward said outlet end and also toward the flame tube central axis so as to intersect substantially at said central axis.

BRIEF DESCRIPTION OF THE DRAWINGS

Reference is now made to the appended drawings and the detailed description which follows, showing two preferred modes of practicing the invention.

BEST MODE FOR CARRYING OUT THE INVENTION

Figure 4:
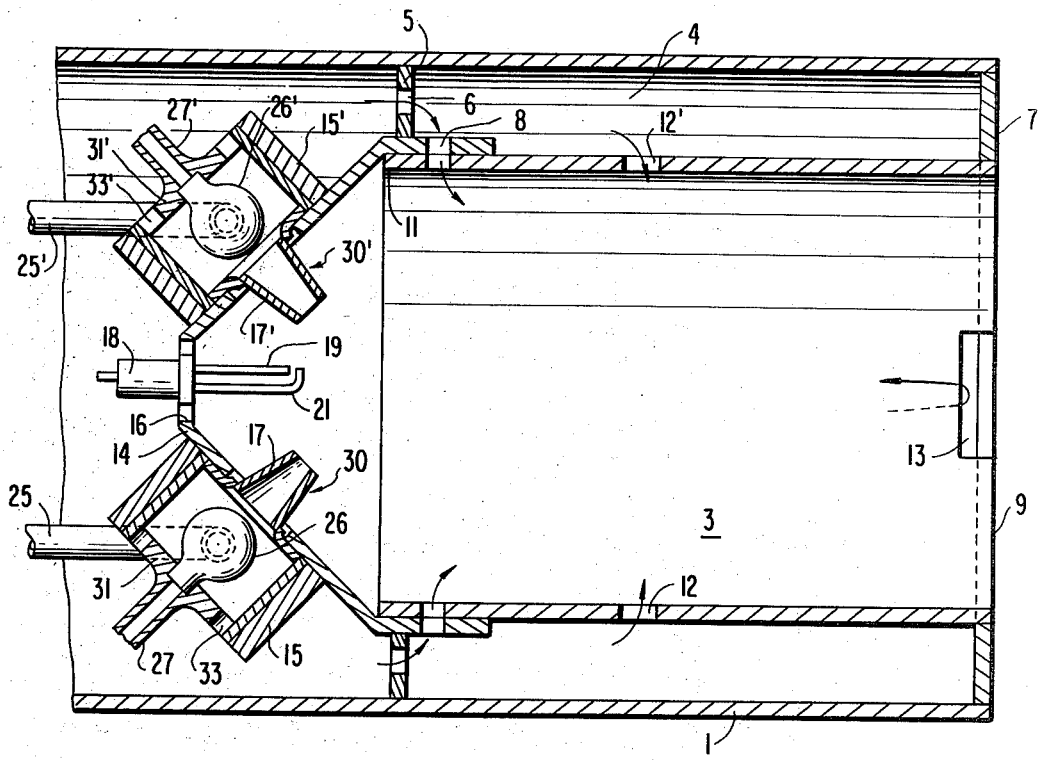
FIG. 4 is a sectional plan view taken along the line 4—4 of FIG. 2 and showing details of one flame tube assembly.

Deferring descriptions of FIGS. 1A and 1B momentarily, consideration will first be given to FIGS. 2 and 4 which show one mode of carrying out the improved fuel burning assembly of the present invention. As shown in FIG. 4, an air tube 1, typically with an outside diameter of about 4", which is essentially an elongated open ended pipe, supports concentrically therein a flame tube 3 which typically is about 3 to $3\frac{3}{4}$ inches in diameter on a plurality of annular rings 5 and 7. The concentric relationship between the air tube and the flame tube defines an annular air passage 4 therebetween. Annular ring 7 is solid so as to close off said annular air passage at the discharge end of the burner assembly for the purpose of directing secondary combustion air as will be discussed later. Annular ring 5 helps to concentrically support flame tube 3 and also contains a series of circumferential holes 6. These holes create a slight pressure drop in the airflow passing through said air passage 4, which in turn equalizes the flow of air through said passage. Hot or downstream end 9 of the flame tube is normally placed in the firebox of the furnace or the like. The other end 11 of flame tube 3 is relatively cool and connects to a foraminous fire wall 14, which is shown as being generally cone shaped, said wall being provided with a relatively large central aperture 16 passing through fire wall 14. Also affixed to said fire wall are two fuel atomizing systems 30 and 30' which are defined by cuplike atomizing chambers 15, 15'. Typically, the apertures in said foraminous fire wall are about $\frac{1}{8}$" in diameter or less, and the large central aperture 16 would be on the order of about $\frac{1}{2}$" to about $1\frac{1}{2}$" diameter.

Further upstream of the fuel atomizing systems and not shown are provisions for housing the burner motor, air compressor, air blower, fuel recirculating system, and electronic burner combustion controls.

The hot end 9 of the flame tube 3 is provided with a pair of cutouts 13, 13', the function of which will become apparent subsequently. Similarly, the flame tube is provided with a further pair of apertures 12,12' located approximately midway of its length. These apertures (12,12') are disposed at 90° relative to the cutouts 13,13'. As shown in FIG. 2, cutouts 13' and 13 are located at the twelve o'clock and six o'clock position, while aperture 12' and 12 are located at the three o'clock and nine o'clock position. However, tube 3 may be rotated 90° so as to reverse the relative positioning of cutouts 13'and 13 with respect to those of apertures 12' and 12. Such reversal will serve only to cause the flame leaving the burner to bush out in the twelve o'clock and six o'clock position, rather than in the three o'clock and nine o'clock position as will be the case with the configuration shown in FIGS. 2 and 4. The function of these cutouts and apertures will be discussed in more detail later.

Projecting into the flame tube through the central opening 16 of wall 14 and disposed midway between the sprays emanating from atomizing systems 30,30' is a conventional spark ignitor 18 which includes a pair of discharge electrodes 19 and 21. The ignitor may be supported by a suitable bracket (not shown) and, of course, is energized from a source of high voltage electricity. In addition, if desired, the gap between electrodes 19 and 21 need not be located midway between the fuel atomizing systems 30,30' but instead can be located adjacent the spray plume from either atomizing system 30 and 30'.

Figure 3:
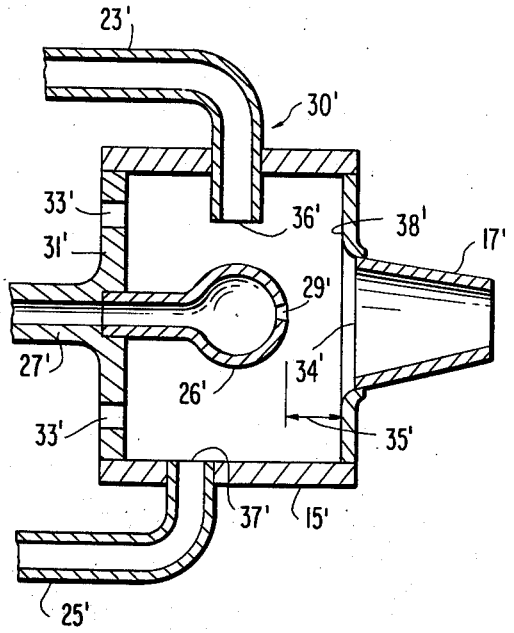
FIG. 3 is a vertical section view taken along the line 3—3 of FIG. 2 and showing details of one of the fuel atomizing systems.

As shown in FIGS. 3 and 4, the atomizing chambers 15 and 15', respectively, may be provided with spray discharge horns 17 and 17', the purpose of which will be discussed later.

FIG. 3 shows that each atomizing chamber 15 is provided with a pair of conduits 23' and 25' which are, in essence, elbows having one end projecting into the chamber along a generally vertical plane passing immediately through the walls thereof. The uppermost conduit 23' defines a fuel supply conduit whose lower end 36' extends into atomizing chamber 15' where it is disposed generally over the high point of atomizing plenum 26'. The upper end 37' of conduit 25' is flush with the lower interior surface of atomizing chamber 15.

Disposed directly below each fuel supply conduit 23' and supported on the rear wall 31' of atomizing chamber 15' is atomizing plenum 26' which is shown in FIG. 3 in the form of a hollow sphere but which may be in the form of any hollow plenum with a smooth convex outer surface. Gas under pressure is supplied to atomizing plenum 26' through conduit 27', which extends through the rear wall 31' of the atomizing chamber 15'. The atomizing plenum 26' is provided with at least one small aperture 29', only one being shown in FIG. 3, which is located so as to discharge fuel spray particles directly toward and through discharge horn 17'.

As clearly shown in FIG. 3, the rear wall 31' of the atomizing chamber 15' is provided with a pair of apertures 33' whose function will be described in detail hereinafter.

Though not shown, it is to be understood that each inlet conduit 23' is connected to a source of liquid fuel by means of a pump whereby the fuel may be pumped through these conduits and deposited on the convex surface of the plenum chamber 26'. Similarly, the drain or discharge conduit 25' is connected to the fuel supply system so that the excess or run-off liquid which is not atomized by air escaping from orifice 29' in atomizer 26' can be returned to the fuel system not shown and recirculated therein. The description given above with specific reference to fuel atomizing system 30' of FIG. 3 applies in identical fashion to fuel atomizing system 30 shown in FIG. 4.

FIG. 3 also shows one means whereby spray discharge horn 17' may be affixed to atomizing chamber 15'. Said horn 17' is shown in its preferred form as a truncated cone with its small opening facing the flame tube. However, in certain burner variations discharge horn 17' may be a simple cylindrical section or even a truncated cone divering outwardly towards the flame tube. The size and shape of spray discharge horn 17 will depend upon the aerodynamic conditions surrounding atomizing chamber 15', as dictated by the upstream blower pressure and the downstream static and dynamic pressure within the flame tube. In any event, the spray discharge horns are designed to control the size of the liquid fuel spray particles and/or to prevent the flame within the flame tube from propagating upstream into the atomizing chamber. These features will be explained further in a subsequent discussion of FIG. 6 which shows an improved discharge horn configuration. In certain applications of the present invention where there is sufficient airflow and pressure available from the auxiliary compressor and combustion air blower, the upstream flame propagation may be prevented, and the liquid particle size optimized, without the need for spray dischrge horn 17'. This is done by controlling the conditions within atomizing chamber 15' and involves the interrelationship of variables such as the size and shape of atomizer 26'; the size and shape of discharge orifice 29'; the pressure supplied to the interior of atomizer 26' via tube 27'; the internal diameter of feed tube 23'; the spacing and relative fore and aft positioning of atomizer 26' with respect to lower end 36 of feed tube 23'; the spacing between discharge orifice 29' and the forward face 38' of atomizing chamber 15'; the quantity of fuel supplied through feed tube 23'; the size of blower inlet ports 33', and the velocity and quantity of air entering atomizing chamber 15' through blower inlet ports 33'. In cases where the spray discharge horns 17 and 17' are not required, they are simply removed with the result that the spray particles emanating from atomzers 26 and 26' are discharged directly into flame tube 3 through openings 34 and 34' in their respective atomizing chambers 15 and 5'.

The following parameters represent some typical values for a burner with a variable firing rate from about 0.2 to about 0.6 gal./hr. A typical atomizer is a sphere or bullet shape between about $\frac{1}{4}''$ to about 1" outside diameter. The cross-sectional area of the discharge orifice 29' typically is about 0.0001 square inch to about 0.0003 square inch. The pressure supplied to the interior of atomizer 26' via tube 27' is typically about 2 psi to about 20 psi. The spacing 35' between discharge orifice 29' and the forward face 38' of atomizing chamber 15' can be from 0 to about 1". The spacing between lower end 36' of liquid feed tube 23' and the upper most surface of atomizer 26' is typically about $\frac{1}{8}''$ to about $\frac{3}{8}''$. The typical dimensions for blower inlet ports 33' are about $\frac{1}{8}''$–$\frac{3}{8}''$ diameter. Typical internal diameters of feed tube 23' are about 1/16"to about $\frac{1}{4}''$. The length of spray discharge horn 17' when present can be up to about $1\frac{1}{2}''$ and have an exit diameter between about $\frac{3}{8}''$ and 1".

Figure 5:
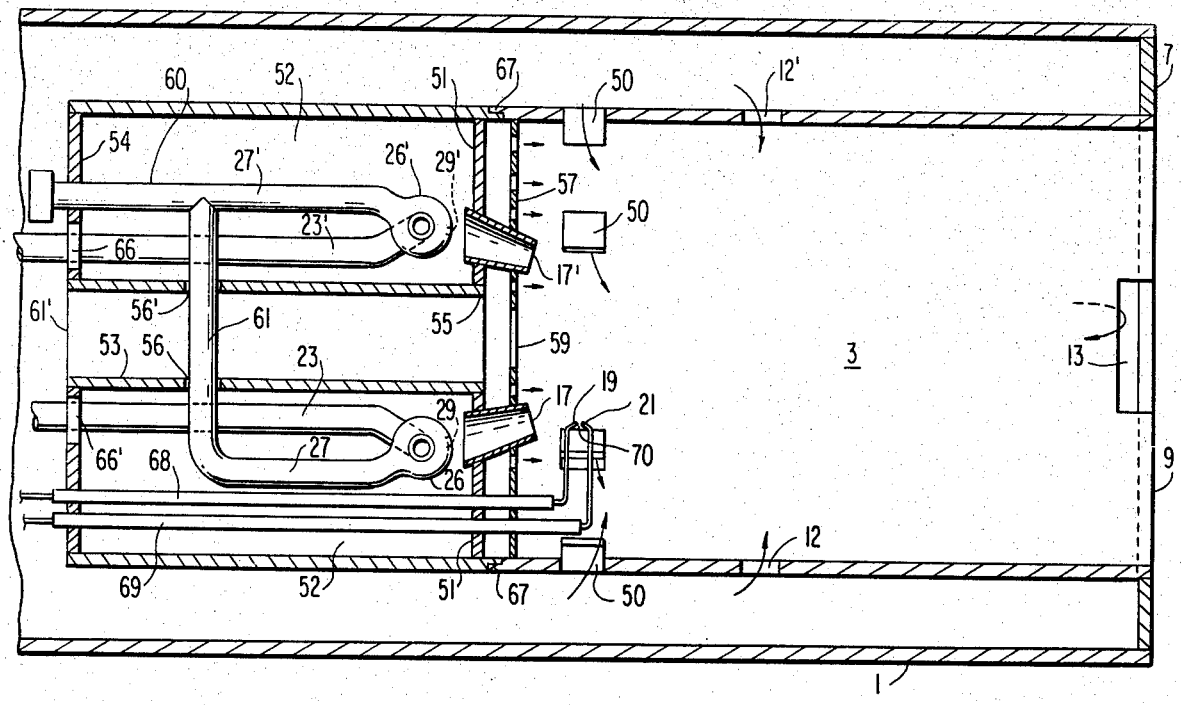
FIG. 5 is a sectional plan view showing details of another flame tube assembly in accordance with the present invention.

FIG. 5 is a sectional plan view showing details of a fuel burning assembly which includes a number of features which are employed to minimize the problem of soot formation which can occur along fire wall 14 and on the inside walls of the flame tube especially at the higher firing rates.

As shown in FIG. 5, the improved fuel burning assembly consists of a air tube 1 which is essentially an elongated open ended pipe. Disposed within air tube 1 is flame tube 3 which is maintained concentric with respect to the air tube so as to define an annular air passage therebetween. Flame tube 3 is maintained concentric to air tube 1 by positioning against a circumferential shoulder 67 which can include set pins or screws (not shown). Other means can be used to maintain the flame tube concentrically within the air tube 1. The flame tube 3 is open at both ends; one end 9 thereof, which may be termed the hot end, faces toward the interior of the firebox of the furnace or the like. The other end which may be called the cool end, is attached to atomizing chamber 52 by means of a slip fit over the aforementioned shoulder 67. Further upstream of atomizing chamber 52 and not shown, provisions may be made to house the auxiliary burner equipment such as the drive motor, air atomizing compressor, combustion air blower, fuel recirculation system and the electronic burner controls, if desired.

The open end 9 of the flame tube 3 is provided with a pair of cutouts 13,13', the function of which will become apparent subsequently. Similarly the flame tube is provided with a further pair of apertures 12, 12' located approximately midway of its length. These apertures (12,12') are disposed at 90° relative to the cutouts 13,13' but as mentioned previously, flame tube 3 may be rotated 90° to alter the flame pattern leaving the burner.

In addition, the flame tube of FIG. 5 is provided with a plurality of centrifugal swirl shutters or louvers 50. One convenient configuraion employs 4 louvers, each being spaced about one-quarter of the circumference of the flame tube from the adjacent louvers. Other configurations and amounts of louvers can be employed if desired. The louvers are placed upstream from the apertures 12,12' and preferably axially about midway between apertures 12,12' and fire wall 57. The louvers provide for a curtain of swirling air along the flame tube wall. The swirling is confined as will be discussed hereinbelow in view of the interrelationship of the louvers with the apertures 12,12' and the cutouts 13,13'. Typically the apertures 50, 12, 12', 13 and 13' are about 0.2 –0.4 square inch in cross-sectional area for a typical burner with a variable firing rate of from about 0.2 to about 0.6 gal./hr.

The cylindrical flame tube 3 is provided at it opposite end 11 with a pair of spray discharge horns 17 and 17', opening into a common atomizing chamber 52. As was previously discussed, certain burner operating conditions would not require the use of spray discharge horns 17 and 17' and in such cases, a simple opening in said atomizing chamber 52 would be provided instead.

Spray discharge horns 17 and 17' are supported upon a solid wall 51 which is shown as being generally straight and transverse to the flame tube. Also supported upon the solid wall 51 is an air blast tube 53 located within and concentrically around the central axis of the atomizing chamber 52. The air blast tube 53 passes through and is also supported by the back wall 54 of atomizing chamber 52. The air blast tube 53 can include a pair of apertures 56,56'(e.g. -typically having a diameter between $\frac{1}{8}$' to $\frac{1}{2}$'') leading to the atomizing chamber 52. These apertures provide for a portion of the blower air entering the central air blast tube to be entrained into the atomizing chamber 52 where it commingles with the fuel spray and is discharged into the flame tube through spray discharge horns 17 and 17'. Should apertures 56 and 56' be insufficient to provide chamber 52 with the needed air to supply the aspiration needs of plenums 26 and 26', or if it is desired to further raise the static pressure within common chamber 52, then blower air inlet ports 66 and 66' similar or smaller cross-sectional area to 56, 56' may be provided in wall 54. Consequently, by sizing blower air inlet ports 66 and 66' in conjunction with apertures 56 and 56', chamber 52 may be operated at any desired pressure. The forward wall 51 of atomizing chamber 52 is provided with a relatively large central aperture 55 passing through the wall 51. This aperture 55 is the same size as the inside diameter of air blast tube 53 which is about $\frac{1}{4}$'' to about $1\frac{1}{2}$'' so that blower air can pass directly through air blast tube 53, and enter the flame tube via aperture 55 in wall 51. Spaced slightly downstream such as about $\frac{1}{8}$'' to about $\frac{1}{2}$'' from the forward wall 51 of the atomizing chamber and parallel thereto, is a foraminous or perforated fire wall 57 which is shown as being generally planar and containing apertures therein. The perforated fire wall 57 is provided with a relatively large central aperture 59 passing through the wall 57. The large central opening 59 in the perforated fire wall 57 is preferably smaller than the inside diameter of the central blast tube and hence the opening 55 in wall 51. As a result, a small amount of air is forced out radially between the forward wall 51 of the atomizing chamber 52 and the perforated fire wall. This air bleeds through the perforated fire wall and into the flame tube to keep the fire within the flame tube from impinging on the fire wall.

Projecting through rear wall 54 and front wall 51 of the atomizing chamber and further extending into the flame tube through a pair of openings in fire wall 57 is a pair of electrodes 19 and 21. Said electrodes are encased in porcelain jackets 68 and 69 to shield said electrodes from fuel spray as they pass through atomizing chamber 52. The spark gap 70 between electrodes 19 and 21 is located within the flame tube and on the outer periphery of the spray plume issuing from atomizer 26.

As shown in FIG. 5, the chamber 52 may be provided with discharge cones 17 and 17' which dicharge atomized fuel inwardly into the flame tube 3.

Both of the atomizing plenum chambers 26,26' are disposed within the same atomizing chamber 52. Plenum 26' is supported on the rear wall 54 of chamber 52 and plenum 26 is interconnected via conduit 27' from plenum 26'. Use of a common chamber assures that the static pressure surrounding atomizing plenum 26 is essentially the same as that surrounding plenum 26'. Plenums 26 and 26' are supplied with air under pressure through conduits 27 and 27' respectively. As shown in FIG. 5, the air is supplied to 27 and 27' from the same source via conduits 60 and 61 respectively. Of course, separate sources of air can be employed if desired.

The liquid fuel supply system for the atomizing plenums is essentially the same as the fuel supply system referred to with respect to FIG. 3 except that both supply lines or conduits are in a common chamber. Also, in the embodiment of FIG. 5, there need only be one common drain located at the low point in atomizing chamber 52. Each atomizing plenum 26 and 26' is provided with at least one small aperture 29 and 29' as illustrated in FIG. 3 which is located so as to discharge air and fuel spray directly toward its associated discharge horn 17 and 17'.

As shown in FIG. 5, the rear wall 54 of the atomizing chamber 52 is provided with an aperture 61' to admit air into the air blast tube 53.

A pair of fuel supply conduits 23 and 23' are preferably connected to a source of liquid fuel by means of a pump, whereby the fuel may be pumped through these conduits and deposited on the convex surfaces of atomizing plenums 26 and 26' respectively. Similarly, the singular drain conduit 25' is connected to the fuel supply system so that liquid which is not atomized within common atomizing chamber 52 can be returned to the fuel system not shown and recirculated back to fuel supply conduits 23 and 23'.

Accordingly, the main difference between the configuration of FIG. 5 as compared to FIG. 4 are a single atomizing chamber instead of two such chambers; a generally planar forward wall or face instead of a generally cone shaped fire wall; a perforated fire wall spaced from the forward wall of the atomizing chamber; and the presence of centrifual swirl shutter or louvers. If desired, the burner of FIG. 4 can be modified by employing less than all of the modifications discussed hereinabove for the embodiment of FIG. 5 by employing any one or any combination of two or more of the new features of the burner illustrated by FIG. 5.

Directing attention now particularly to FIGS. 3 and 4, the operation of the fuel atomizing and combustion system is as follows.

Liquid fuel is introduced into the system by the conduits 23,23'. The liquid fuel flows over atomizing plenums 26,26' and a portion thereof is atomized by air under pressure which is introduced into each plenum through conduits 27 and 27'. Liquid which is not atomized flows to the bottom of the atomizing chambers 15, 15' and is withdrawn therefrom by drain conduits 25,25' for recirculation in the fuel supply system.

As described above, the atomization process utilizes the basic "Babington" principle disclosed in prior mentioned U.S. Pats. Nos. 3,421,699 and 3,421,692.

Due to the discharge of air from the atomizing plenums through apertures 29 and 29' there is created a low pressure region in the immediate vicinity of said apertures. This causes additional air to flow into atomizing chambers 15,15' through ports 33, 33' to commingle with the atomized fuel being discharged into flame tube 3. Additional combustion air is supplied through the aperture 16 in the foraminous fire wall 14, so as to flow axially along flame tube 3 to intersect with the fuel sprays emanating from atomizers 26 an 26' so as to readily ignite when the igniter 18 is energized to cause a spark between electrodes 19 and 21.

In the preferred embodiments disclosed herein, the combustion air enters through the aperture 16. It is, however, within the scope of the invention to supply such combustion air by increasing the supply of air which enters the atomizing chambers through the ports 33 and 33' in FIG. 4, or the ports 66,66' in FIG. 5. This in turn will supply more air to flame tube 3 through discharge horns 17 and 17'. The two streams of additional air thus provided intersect substantially along the flame tube axis, and the resultant of these two intersecting airstreams tends to flow generally along the axis of the flame tube. Such an arrangement may be satisfactory in certain instances, particularly where the burner geometry may make it difficult to provide for the combustion air to be directed into the flame tube from one end thereof, or in instances where the burner is designed for a low firing rate in which event sufficient combustion air is obtained by such an alternative arrangement.

Additional combustion air passes along the annular passage 4 between flame tube 3 and blast tube 1 and is staged into the interior of the flame tube 3 through the staging ports 12,12' and the cutouts 13,13'. FIG 4 also shows one means whereby additional combustion air may be provided at the juncture between the flame tube and the conical fire wall as, for instance, a multiplicity of ports 8.

The unique configuration of the flame tube within a blast tube provides a unique heat exchanger in which combustion air for staging purposes passed through the annular area between the flame tube and the blast tube. In traversing this route, the combustion air picks up heat from the inner hot walls of the flame tube. This hot air, as it is delivered to the interior of the flame tube at the two aforementioned staging locations and through ports 8, if desired, helps to promote rapid vaporization of the atomized fuel to complete the combustion process downstream in the flame tube. The staging of combustion air in this manner allows the temperature within the flame tube to be maintained at the desired level to keep nitrous oxide emissions to a minimum.

Still another advantage of the manner in which combustion air is staged is to produce a flame in which, when emitted from the burner, is short and bushy. This is achieved by introducing stated air in a nonsymmetrical manner which is contrary to the fuel/air mixing technique used in conventional resisdential type oil burners. For example, at the first combustion air staging location, downstream from the spray impingement site, two air blasts 12,12' may be introduced perpendicular to the long axis of the blast tube, at three o'clock and nine o'clock locations. By subjecting the flame within the flame tube to a nonsymmetrical air blast of this type, the flame is caused to squirt out and fill the flame tube at the six o'clock and twelve o'clock positions. Furthermore, the low static pressure within the air blasts at the three and nine o'clock positions causes the flame to wrap around the air blasts and thus produce a shorter and more compact flame which fills the entire flame tube.

In the second combustion air staging location, two air blasts are introduced at the lip of the blast tube but this time the air blasts are introduced at the twelve o'clock and six o'clock positions. The causes the flame to spread out in the three o'clock and nine o'clock positions as it leaves the burner blast tube and enters the combustion chamber.

A short bushy flame of this type is ideal for a retrofit or replacement burner, because it is suited for use in any type of combustion chamber. This is in contrast to a long thin flame which would impinge upon the back side of many combustion chambers and cause erosion of the combustion liner. At the same time, the combustion air passing between the flame tube and the blast tube serves to keep the outer blast tube cool, thereby preventing heat erosion of the blast tube. In the case of the present invention, the atomization system is so efficient, and the subsequent fuel/air mixing and vaporization is likewise carried out in such a highly efficient manner, that the burner does not require a hot combustion chamber to achieve high combustion performance.

The present burner design of FIG. 4 has been utilized in a wide variety of different combustion chambers and has always been able to achieve smokeless operation, and flue-gas $CO_2$ levels between 14–141/2%, when operating at a firing rate which is close to that of the furnace rating. Even when the present burner is set to operate at firing rates well below the furnace rating (e.g. burner operating at 0.25 gal./hr. in a 1.0 gal./hr. furnace) $CO_2$ levels with smokeless operation will normally never fall below 13%.

The burner configuration illustrated in FIG. 5 is somewhat better in performance than that illustrated in FIG. 4. For instance, flue-gas $CO_2$ levels of 15%, which are approximately the maximum level, have been achieved at zero smoke. This value is just below the theoretically obtainable when the precise amount of air is mixed with the hydrocarbon fuel. This is in contrast to the average conventional home oil burner that operates at $CO_2$ levels of 8% even when the burner firing rate is matched to the furnace capacity.

These characteristics of total independence of furnace design and furnace temperature makes the present invention ideal as a replacement of retrofit burner. This non-dependence of furnace temperature also means that the present burner will achieve smokeless operation the instant ignition occurs and before the combustion chamber becomes hot. The typical conventional high pressure burner takes several minutes for the smoke level to drop to acceptable levels after ignition has occurred.

Another fact to be noted is that conventional high pressure nozzles have difficulty operating at firing rates below approximately 0.7 gal./hr. without encountering a high incidence of clogging. In the present burner, there is essentially no minimum firing rate that can be attained; a prototype burner has been operated at a firing rate of less than 0.1 gal./hr. This means that each individual atomizer is operating at less than 0.05 gal./hr. Further, it is not necessary, in the present burner, that both atomizers be generating the same amount of fuel spray for the burner to operate efficiently. For example, one atomizer may have a firing rate of 0.06 gal./hr. while the other has a firing rate of 0.04 gal./hr. A burner of this type will operate just as efficiently as one in which each atomizer is delivering a spray rate of 0.05 gal./hr. This low firing rate capability of the present invention is very important in light of the present energy crisis because homes in the future will be built with better insulation and the trend is towards low firing burners that can provide highly efficient operation.

It should be noted that the perforations in the fire wall 14 are so numbered and sized that a very soft flow of air passes through this wall. This soft air flow tends to keep products of combustion from filtering or rolling back toward the fuel atomizing systems and the ignitor, thus inhibiting sooting of these elements.

The included angle between the fuel atomizing systems 30,30' is shown in FIG. 4 as being approximately 90°. This angle can be varied, however, and may be between 15° and 150°, and preferably between 45° and 150°.

Figure 1A:
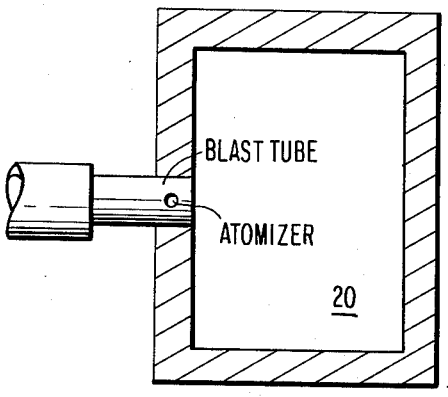
FIG. 1A PRIOR ART
FIGS. 1A and 1B are schematic views of a typical heating furnace or firebox and showing the utility of the present invention as compared to the usual prior art apparatus.
Figure 1B:
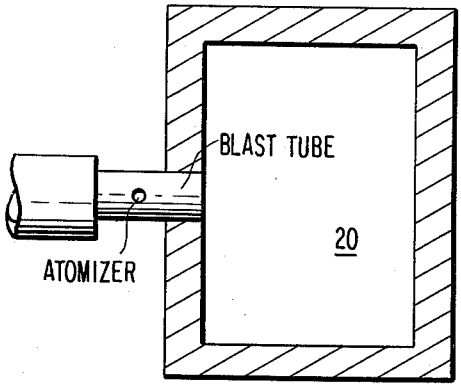
Figure 2:
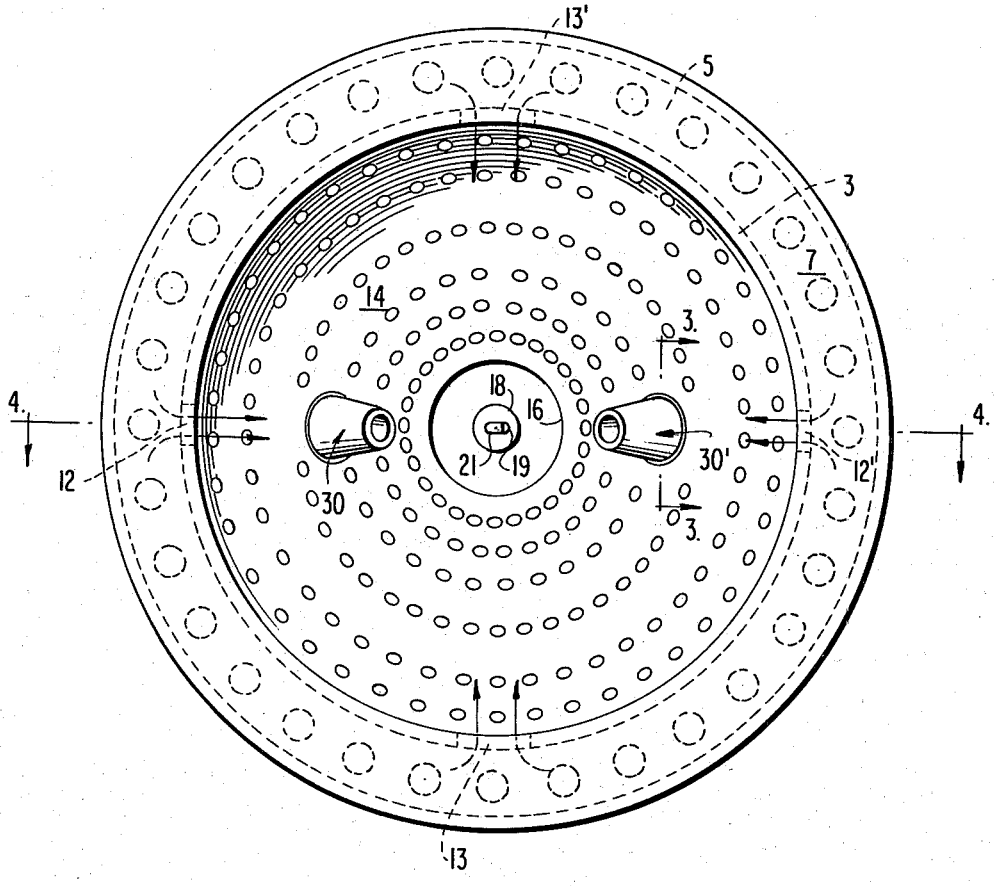
FIG. 2 is a front end view of a fuel burner assembly as utilized in the firebox referred to in FIG. 1.

Turning now to FIGS. 1 and 1A, it will be noted that in the prior art the atomizing nozzles are located at the end of the blast tube. Consequently, the nozzle is subjected to high temperatures, and as such is subject to varnish depositions and clogging.

In contrast, utilizing applicant's improved fuel burning system, the atomizing plenums are located well upstream from the end of the blast tube and as such are sheltered from the radiant and convective heat of the firebox and the associated problems of fuel cracking and varnishing.

Even though burners made in accordance with FIGS. 3 and 4 are very efficient and quite satisfactory as discussed hereinabove, the operation of such at the higher fuel rates can lead to some limited amount of sooting on conical fire wall 14 and on portions of the flame tube. The improved configuration illustrated by FIG. 5 eliminates all soot formation. Only the basic differences between the operation of the burner illustrated by FIG. 5 and that of the burner illustrated by FIG. 4 will be discussed hereinbelow, it being understood that those aspects of the operation of the burner illustrated by FIG. 5 not discussed in any detail are similar to those of the burner of the type shown by FIG. 4.

The air blast tube 53 directs air along the central axis of the single atomizing chamber 52 and along the central axis of the flame tube 3. A portion of the blower air entering the air blast tube 53 is preferably entrained or forced into the atomizing chamber 52 via openings 56 and 56' where it commingles with the fuel spray and is discharged into the flame tube 3 via spray discharge horns 17 and 17'. The atomizers may draw the air into the chamber 52 via apertures 56 and 56' by the low pressure area created at the orifices of said atomizing plenums, or under certain operation conditions pressurized air may also be forced into atomizing chamber 52 through apertures 56 and 56'. As stated earlier, common chamber 52 may also be fitted with blower air pressurization ports 66 and 66' so that common chamber 52 may be operated at still a more elevated static pressure if so desired. Such pressurization would more likely be employed at high firing rates and where it is desirous to mix as much air with the atomized spray as possible before discharging the mixture into the flame tube.

The use of one common atomizing chamber to contain the atomizing plenums instead of a plurality of atomizing chambers assures that the ambient pressure surrounding each atomizing plenum will be essentially the same. With a common atomizing chamber the local air velocity around each atomizer is also reduced because of the larger volume inside common chamber 52. Thus in chamber 52 it is further assured that high air velocities will not disturb the film of liquid flowing over atomizers 26 and 26'. The configuration of FIG. 5 is therefore less sensitive than that shown in FIG. 4.

Since the large central opening in the perforated wall is smaller than the inside diameter of the central air blast tube 53, a small amount of air is directed or forced radially outwardly between the forward face of the atomizing chamber and the perforated fire wall. The perforations in the fire wall are so numbered and sized that a very soft flow of air passes through this wall. This air bleeds through the perforated fire wall and into the flame tube, thereby keeping or holding the flame off the fire wall, and insulating the relatively cool surface of the front face of the atomizing chamber from the hot environment on the downstream side of the fire wall. Without the perforated fire wall the condition of relatively cool fuel on the inside of the atomizing chamber, and a hot fire on the downstream side of the atomizing chamber would predispose the forward wall of the atomizing chamber to soot buildup on the flame tube side. In addition, the use of generally straight walls instead of the generally cone shaped fire wall of FIG. 4 minimizes the tendency for soot buildup since in the configuration of FIG. 4, the number of corners involved makes it difficult to provide sufficient air mixing to all of the corners.

The use of a substantially planar faced fire wall removes the restriction on the minimum spray angle as stated for the sprays in FIG. 4. The use of the planar face fire wall permits the minimum included angle where sprays meet to be reduced substantially. The preferred minimum included angle is about 5°. Excellent results have been achieved with an angle of about 27°.

The centrifugal swirl shutters or louvers 50 promote rapid mixing of combustion air and fuel spray to prevent soot buildup on the flame tube 3. The air which passes into the flame tube through the centrifugal swirl shutters provides a curtain of swirling air along the flame tube wall. This insulates the flame tube wall from direct flame impingement and prevents hot spots and flame erosion problems. The curtain of swirling air is heaviest in the upstream vicinity of the flame tube where it enters through the louvers. When the swirling air encounters the transverse air blasts about midway along the flame tube from apertures 12,12', and again at the discharge lip of the flame tube from cutouts 13,13', the swirling motion is substantially destroyed. This is important to assure that the swirling air is mixed with the vaporized and burning fuel before it exits flame tube 3.

Figure 6:
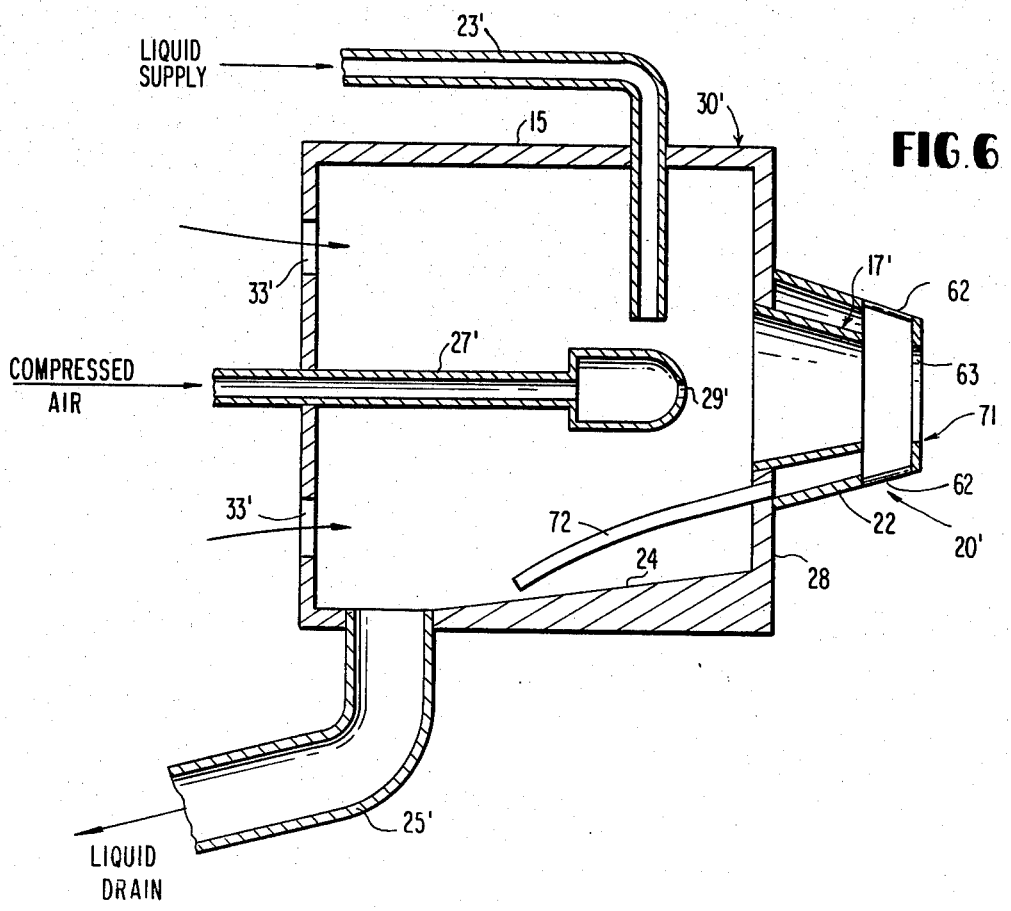
FIG. 6 is still another sectional view of a fuel atomizing system in which an improved spray discharge horn is utilized.

It was discussed hereinabove with respect to FIG. 3 that the spray discharge horn 17' served two purposes. Horn 17' was designed to control the mass median diameter of the spray entering flame tube 3 and also to prevent the flame within flame tube 3 from propagating upstream and into atomizing chamber 15. The spray particle size can be optimized by adjusting the geometry of horn 17' with respect to its length, exit diameter and conical angle. Said horn can be sized such that the spray issuing forth from orifice 29' is discharged into flame tube 3 unrestricted by horn 17', or said horn may be designed to restrict a portion of the spray emanating from 29'. In this latter case, the inner walls of said horn serve to skim off the larger spray particles on the outer periphery of the spray plume. These captured fuel particles simply flow back into atomizing chamber 15 along the inclined inner walls of said spray discharge horn 17'. This technique works well when the skimming required is minimal, and when the velocity of the commingled air and fuel particles passing through said horn is low. However, when it is desired to restrict a substantial amount of the spray to further reduce particle size, or when velocities within discharge horn 17' are high, the discharge horn assembly shown in FIG. 6 is more useful. This high velocity discharge horn assembly 20 is comprised of an inner shroud 17' and an outer shroud 22. As shown in FIG. 6 the downstream ends of these shrouds are preferably in the same plane. However, in some cases, depending upon the static pressure, combustion air velocity, and local eddies within flame tube 3, outer shroud 22 may be somewhat longer or shorter than inner shroud 17' to promote better drainback and/or to eliminate soot buildup between said shrouds or around the entire configuration 20'.

In operation the high velocity discharge horn assembly 20 shown in FIG. 6 skims off a portion of the fuel spray originating from orifice 29'.

The relatively high velocity of the spray passing through inner shroud 17' causes impinging fuel to run along the inner walls of shroud 17' towards the flame tube. This raw fuel is prevented from spilling over into the flame tube by means of the outer shroud 22. Said raw fuel upon reaching the discharge lip of the inner shroud 17' runs back between said inner shroud and said outer shroud 22, mostly along the outer surface of the inner shroud 17, and back towards the forward wall 28 of the atomizing chamber 15. This excess or run-off fuel then drains back into chamber 15 via small drain tube 72. During burner operation, drain tube 72 which has an I.D. of approximately 1/16–⅛" becomes filled with fuel and acts as a trap to prevent the back flow of combustion products into the atomizing chamber.

The other purpose of high velocity discharge horn assembly 20 is to prevent burn back in the atomizing chamber. Essentially the assembly acts as an ejector which is sized such that the fuel/air velocity exiting from said inner shroud 17' is at least as great as the flame speed of the fuel burning within flame tube 3. This means that the flame within the flame tube cannot propagate upstream and into atomizing chamber 15'.

In cases where the velocity of commingled liquid spray and air exiting from discharge horn assembly 20' is very high so as to cause flame instability or a fluctuating flame front within the flame tube 3, then flame holder 71 may be provided. Said flame holder is in the form of a simple ring or washer having a large central opening 63, said opening being sized slightly larger than that of the spray plume diameter at that point. This allows the fuel spray to pass unimpeded through said opening 63 without wetting the walls of said flame holder 71. The turbulence and subsequent low static pressure that is created around flame holder 71 when the spray passes through it, causes the flame to seat or attach itself to the downstream face of flame holder 71. In FIG. 6 said flame holder 71 is supported from outer shroud 22 by two small rod like appendages 62. It is desirable that these rods 62 be small in cross-section so that flame holder 71 takes on the appearance of being suspended in space approximately ⅛–1½" downstream of the exit of inner shroud 17'. The exact location of flame holder 71 will depend upon the relative velocity between the flame speed and the fuel/air mixture leaving shroud 17'.

Having described a preferred mode of practicing the invention, it will be apparent to those skilled in the art that various modifications and changes can be made therein; which modification and changes fall within the purview of the inventive concept defined by the appended claims wherein what is claimed is:

1. A liquid fuel burner comprising:

a flame tube having an inlet end and an outlet end, an atomizing chamber communicating with said inlet end of said flame tube and enclosing fuel atomizing means for discharging atomized fuel into said flame tube through openings in a dividing wall separating said flame tube from said atomizing chamber, said atomizing means comprising a plurality of hollow plenum chambers each having a smooth outer surface and each defining therein a small through aperture, a means for producing a flow of fuel in a thin film over each said through aperture and a means for introducing air under pressure into each said plenum chamber to rupture said film at said aperture, means for supporting said plenum chambers in said atomizing chamber in a manner to cause the plurality of directional streams of atomized fuel issuing therefrom to be directed through respective ones of said openings in said dividing wall into said flame tube in directions extending toward and along the central axis of said flame tube for combustion of substantially all said atomized fuel within said flame tube, means for introducing air into said atomizing chamber to thereby cause low velocity air to issue through said openings in said dividing wall along with said streams of atomized fuel and said pressurized air issuing from each said plenum chamber, means for igniting the atomized fuel in said flame tube downstream of its said inlet end, first means for introducing air into said flame tube adjacent its inlet end with a tangential component to produce in said flame tube a single tangential vortex to promote the admixing of air with the atomized fuel and to maintain the flame spaced from the flame tube's inner surface adjacent its inlet end, and second means for introducing air into said flame tube at at least one location downstream of the location of air introduction by said first means and downstream of the point of ignition of the fuel-air mixture by said ignition means with a velocity and direction to impede the tangential vortex generated by said first means so as to permit the flame to expand to the flame tube wall and to permit substantially complete combustion within the confines of the flame tube.

2. The burner of claim 1 in which a foraminous radiation shield is supported adjacent to but spaced from the side of said dividing wall facing said flame tube.

3. The burner of claim 2 which further includes a spray discharge cone for each said plenum chamber, each said spray discharge cone being truncated with its larger end adjacent the through aperture of the respective plenum chamber and extending through said respective opening in said dividing wall and said radiation shield.

4. The burner of claim 2 in which both said shield and said dividing wall define a central aperture for producing a flow of air from a source of pressurized air along the central axis of said flame tube.

5. The burner of claim 4 which further includes a central tube extending from said air source through said apertures in said dividing wall and shield and into said inlet end of said flame tube.

6. The burner of claim 1 in which said first means comprises a plurality of louvers formed in said flame tube wall.

7. The burner of claims 1 or 6 in which said second means comprises a plurality of apertures in said flame tube disposed substantially at the mid-length thereof.

8. The burner of claims 1 or 6 in which said second means comprises a plurality of apertures in said flame tube substantially at its outlet end.

9. The burner of claims 1 or 2 in which said second means comprises a first plurality of apertures in said flame tube substantially at the mid-length thereof and a second plurality of apertures in said flame tube substantially at its said outlet end.

10. The burner of claim 1 which further includes means for pressurizing said atomizing chamber with a pressure above atmospheric.

11. The burner of claim 1 which further includes air channel means for conveying air via said first and second means to the interior of said flame tube.

12. The burner of claim 11 in which said air channel means includes a tube of larger diameter than, and surrounding, said flame tube to define an annular channel.

13. A liquid fuel burner comprising:

a flame tube having an inlet end and an outlet end, an atomizing chamber communicating with said inlet end of said flame tube and enclosing fuel atomizing means for discharging atomized fuel into said flame tube through openings in a dividing wall separating said flame tube from said atomizing chamber, said atomizing means comprising a plurality of hollow plenum chambers each having a smooth outer surface and each defining therein a small through aperture, means for producing a flow of fuel in a thin film over each said through aperture and a means for introducing air under pressure into each said plenum chamber to rupture said film at said aperture, means for supporting said plenum chambers in said atomizing chamber in a manner to cause the plurality of directional streams of atomized fuel issuing therefrom to be directed through respective ones of said openings in said dividing wall into said flame tube in directions extending toward and along the central axis of said flame tube, means for pressurizing said atomizing chamber with above atmospheric pressure to thereby cause low velocity air to issue through said openings in said dividing wall along with said streams of atomized fuel, means for igniting the atomized fuel in said flame tube downstream of its said inlet end, and means for introducing air into said flame tube at at least one location along its length for admixing with the atomized fuel.

* * * * *

UNITED STATES PATENT AND TRADEMARK OFFICE

CERTIFICATE OF CORRECTION

PATENT NO. : 4,298,338
DATED : November 3, 1981
INVENTOR(S) : Robert S. Babington It is certified that error appears in the above—identified patent and that said Letters Patent is hereby corrected as shown below:

At Column 1, below the title "LIQUID FUEL BURNERS" insert (centered on the column)

--Cross Reference to Related Application-- below the heading insert the following:

--This application is a continuation-in-part of my co-pending U.S. patent application Serial No. 755,938, filed December 30, 1976 and entitled, LIQUID FUEL BURNERS and now U.S. Patent 4,155,700.--

Following the line "[22] Filed: May 8, 1979" insert (centered on the column)

--Related U.S. Application Data-- insert below the heading:

--[63] Continuation-in-part of Serial No. 755,938, Filed December 30, 1976--.

Signed and Sealed this

*Twenty-third* Day of *March 1982*

[SEAL]

*Attest:*

GERALD J. MOSSINGHOFF

*Attesting Officer*

*Commissioner of Patents and Trademarks*